US006299225B1

(12) United States Patent
Chang

(10) Patent No.: US 6,299,225 B1
(45) Date of Patent: Oct. 9, 2001

(54) ELECTRICAL LOCK DEVICE

(76) Inventor: Chih Chung Chang, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 09/407,612

(22) Filed: Sep. 28, 1999

(51) Int. Cl.[7] ..... E05B 15/02
(52) U.S. Cl. ..... 292/341.16; 292/DIG. 60
(58) Field of Search ..... 292/341.16, 144, 292/201, DIG. 60

(56) References Cited

U.S. PATENT DOCUMENTS 3,910,617 * 10/1975 Scalza ..... 292/341.16
4,211,443 * 7/1980 Butts ..... 292/341.16
4,626,010 * 12/1986 Hanchett ..... 292/341.16
5,219,196 * 6/1993 Luker ..... 292/341.16
5,228,733 * 7/1993 Winters ..... 292/300
5,484,180 * 1/1996 Helmar ..... 292/341.16
5,490,699 * 2/1996 Uyeda ..... 292/341.16
5,690,373 * 11/1997 Luker ..... 292/341.16
5,876,073 * 3/1999 Geringer ..... 292/341.16

* cited by examiner

*Primary Examiner*—Gary Estremsky

(57) ABSTRACT

An electrical lock device includes a lever pivotally secured in a housing, and a solenoid device received in the chamber of the housing. The solenoid device may be adjustably secured to the housing at a position where the solenoid device is disengaged from the lever when the solenoid device is energized and at the other position where the solenoid device is engaged with the lever when the solenoid device is energized. The electric lock device may thus be adjusted to fit the functions and the operations of both kinds of the electric lock devices.

5 Claims, 5 Drawing Sheets

ELECTRICAL LOCK DEVICE

BACKGROUND OF THE INVENTION

1. Field of the Invention

The present invention relates to a lock, and more particularly to an electrical lock device.

2. Description of the Prior Art

Typical electrical lock devices comprise a solenoid device for actuating a plunger to lock the door or to release the door. For some typical electrical lock devices, the plunger may be actuated to lock the door only when it is energized. For other typical electrical lock devices, the plunger may be actuated to lock the door only when it is not energized. The users or the workers have to purchase the correct lock devices.

The present invention has arisen to mitigate and/or obviate the afore-described disadvantages of the conventional electrical lock devices.

SUMMARY OF THE INVENTION

The primary objective of the present invention is to provide an electrical lock device which may be adjusted to lock the door either when the solenoid device is energized or is not energized.

In accordance with one aspect of the invention, there is provided an electrical lock device comprising a housing including a chamber formed therein, a lever pivotally secured to the housing at a pivot shaft, a solenoid device received in the chamber of the housing, and means for adjusting and securing the solenoid device to the housing between a first position where the solenoid device is disengaged from the lever when the solenoid device is energized and a second position where the solenoid device is engaged with the lever when the solenoid device is energized.

The housing includes a first hole and a second hole formed therein, the adjusting and securing means includes a fastener engaged through the first hole of the housing and secured to the solenoid device for securing the solenoid device to the housing at the first position, and engaged through the second hole of the housing and secured to the solenoid device for securing the solenoid device to the housing at the second position The first hole and the second hole of the housing are arranged in a stagger way relative to each other. The solenoid device includes a bracket secured thereto, the bracket includes a first screw hole and a second screw hole formed therein for selectively threading with the fastener.

A guiding means is further provided for guiding the solenoid device to move in the housing and includes an oblong hole formed in the housing, and a knob slidably received in the oblong hole of the housing and secured to the solenoid device for guiding the solenoid device to move in the housing when the knob is slid along the oblong hole of the housing.

The solenoid device includes a plunger slidably received therein, and a block secured to the plunger, the block is caused to engage with the lever and to prevent the lever from being depressed inward of the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
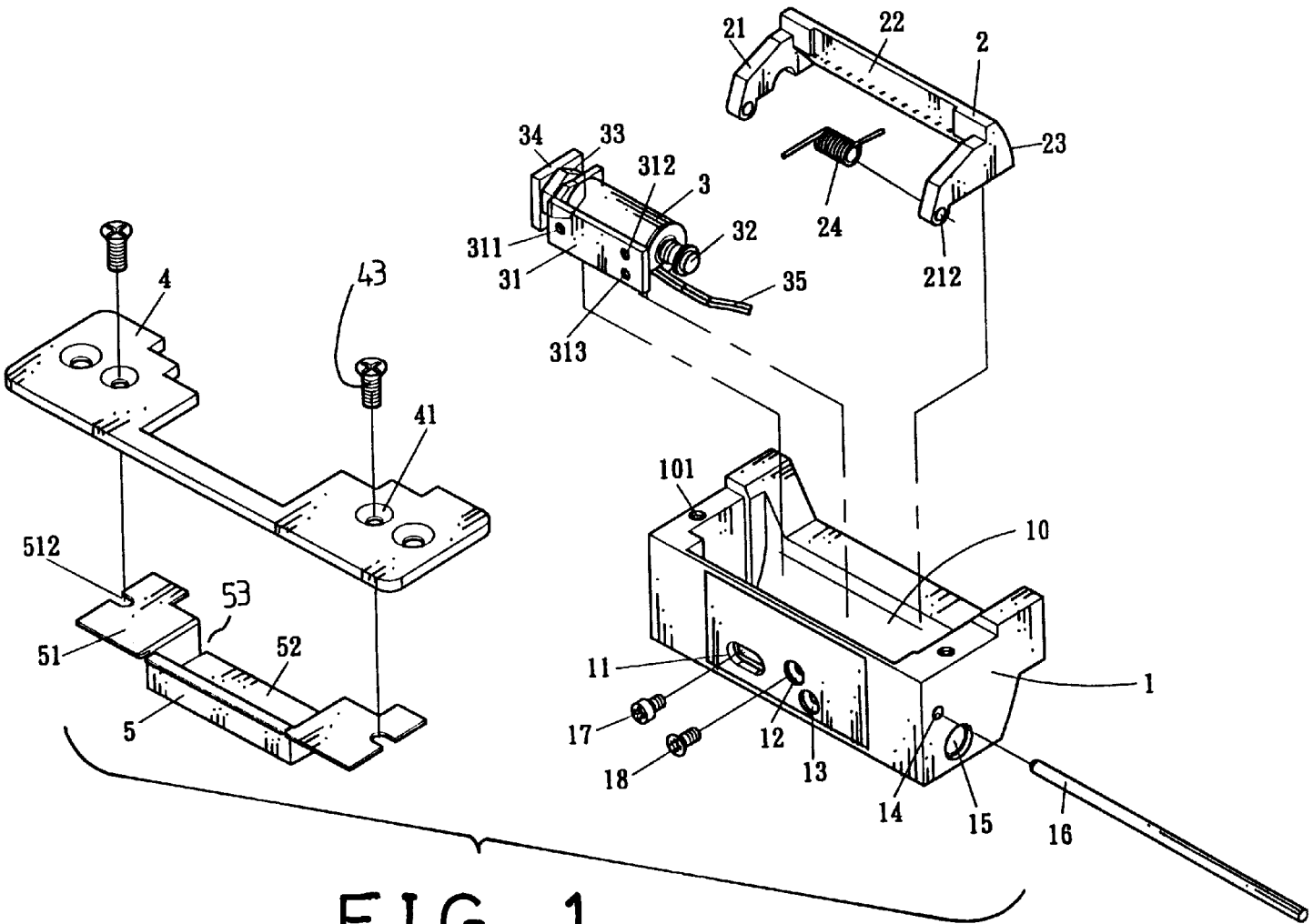
FIG. 1 is an exploded view of an electrical lock device in accordance with the present invention.
Figure 2:
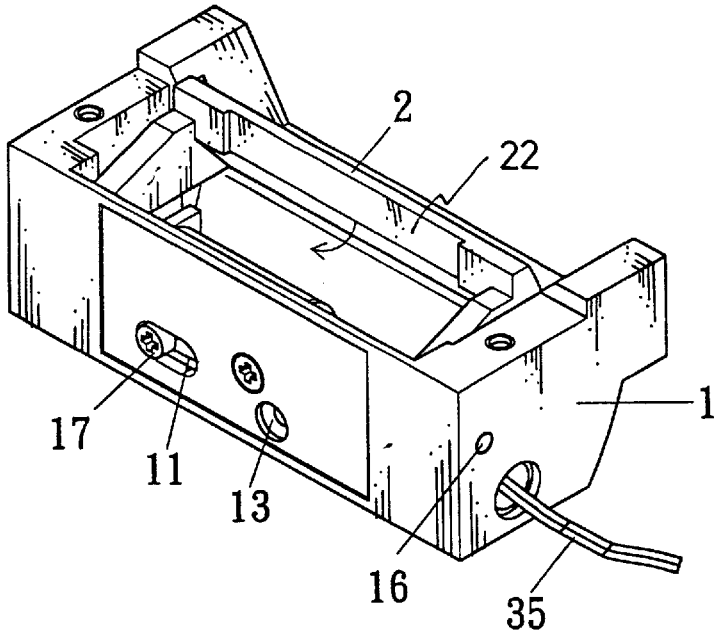
FIG. 2 is a perspective view of the electrical lock device, in which the cover and the casing have not been secured onto the housing yet.
Figure 3:
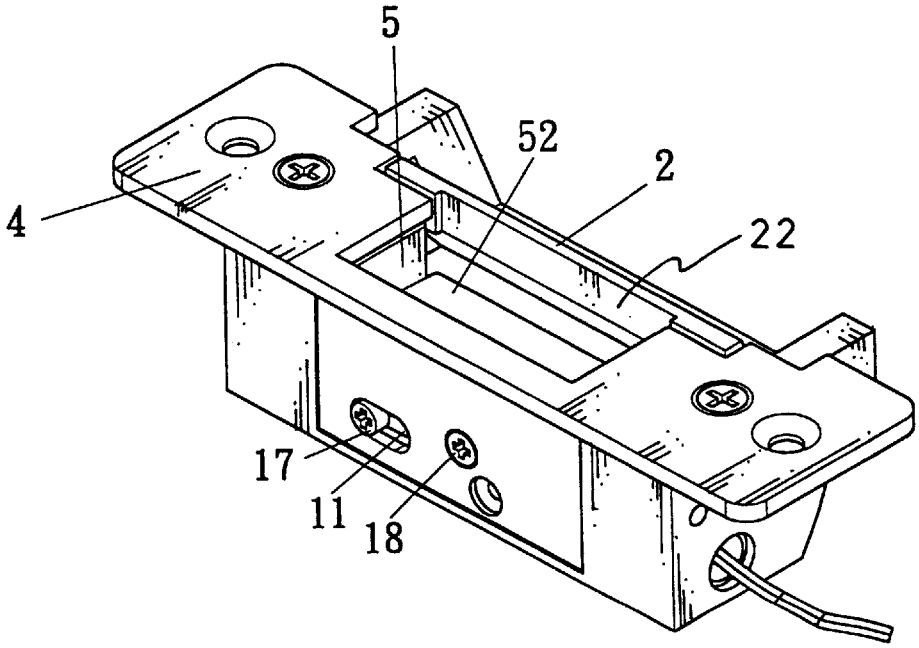
FIG. 3 is a perspective view of the electrical lock device, in which the cover and the casing have been secured onto the housing.

Referring to the drawings, and initially to FIGS. 1–4, an electrical lock device in accordance with the present invention comprises a housing 1 including a chamber 10 formed therein for slidably receiving a typical solenoid device 3 which includes a plunger 32 slidably received therein and which is secured to a bracket 31, such as a U-shaped bracket 31 with one or more fasteners, such as the locking nut 33. A stop or a block 34 is secured to one end of the plunger 32 and moved in concert with the plunger 32. The housing 1 includes an oblong hole 11 formed therein for slidably receiving a fastener or a knob 17 which is secured and threaded to a screw hole 311 of the bracket 31 such that the knob 17 may slide and move the solenoid device 3 and the bracket 31 in the chamber 10 of the housing 1. The housing 1 includes two separated screw holes 12, 13 formed therein for selectively threading with a fastener, such as the screw 18. The screw holes 12, 13 are arranged in a stagger way or are not aligned with each other, and may be selectively aligned with the respective screw holes 312, 313 of the bracket 31 by moving the bracket 31 with the knob 17. The solenoid device 3 may be coupled to the electric source with one or more electric wires 35 which may be engaged outward of the housing 1 via the aperture 15 of the housing 1.

A lever 2 includes two arms 21 extended therefrom and pivotally coupled to the housing 1 at a pivot shaft 16 which is engaged through one or more holes 14 of the housing 1 and which is solidly or pivotally secured to the housing 1 and which is engaged through the holes 212 of the arms 21 of the lever 2. The lever 2 includes a curved outer surface 23 and includes a tapered or inclined inner surface 22 formed therein and facing toward the solenoid device 3. A spring 24 is engaged on the pivot shaft 16 and has one end secured to the housing 1 and the other end engaged with the lever 2, such as engaged with one arm 21 of the lever 2 (FIGS. 4–7), for biasing the lever 2 outward of the housing 1, and for elevating and separating the arms 21 of the lever 2 from the block 34 of the solenoid device 3, and for allowing the block 34 to be moved to engage with or away from the arms 21 by the plunger 32 of the solenoid device 3 (FIGS. 4–7). A casing 5 includes a space 53 formed therein and defined by a bottom panel 52, and includes two flaps 51 extended therefrom and having a hole or a notch 512 aligned with the screw holes 101 of the housing 1 for receiving fasteners 43. A cover 4 includes two holes 41 for receiving the fasteners 43 which may engage through the notches 512 of the casing 5 and which may thread to the screw holes 101 of the housing 1 for securing the cover 4 and the casing 5 to the housing 1.

As shown in FIGS. 1–5, when the knob 17 is moved to one end of the oblong hole 11 of the housing 1, the screw hole 312 of the bracket 31 may be aligned with the screw hole 12 of the housing 1 and threaded with the fastener 18. At this moment, the block 34 of the solenoid device 3 is moved to one position located below one of the arms 21 of the lever 2 and to engage with the arm 21 of the lever 2 (FIG. 4), such that the lever 2 may not be depressed inward of the housing 1 against the spring 24 and such that the lever 2 and thus the electrical lock device may be locked in the locked position. When the solenoid device 3 is energized to move the plunger 32 and to disengage the block 34 from the arm 21 of the lever 2 (FIG. 5), the lever 2 is in a released position and may be moved inward of the housing 1 against the spring 24. It is preferable that the screw hole 313 of the bracket 31 is disengaged from the screw hole 13 of the housing 1 and shielded in the housing 1 when the fastener 18 is threaded to the screw hole 312 of the bracket 31.

Figure 6:
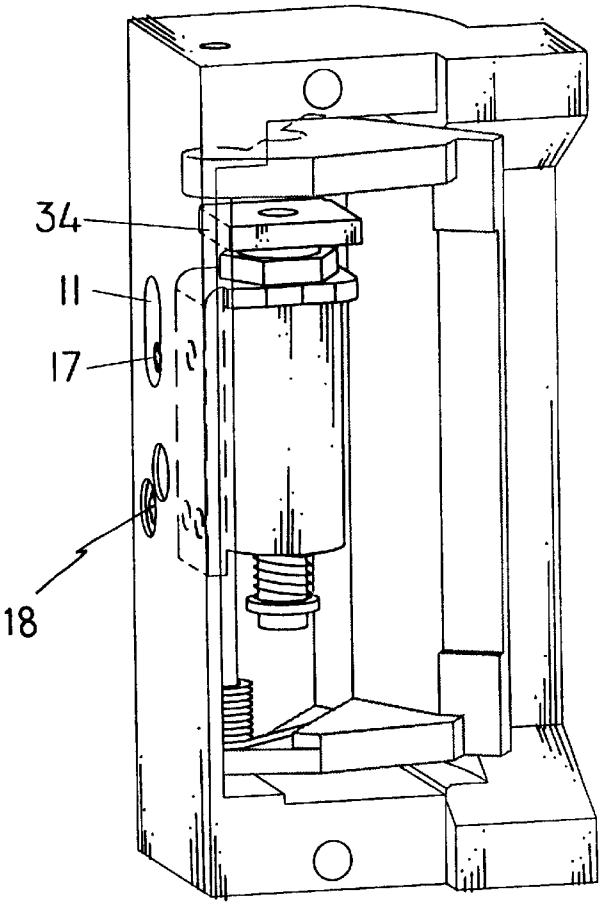
FIGS. 6 and 7 are perspective schematic views illustrating the other application of the electrical lock device.
Figure 7:
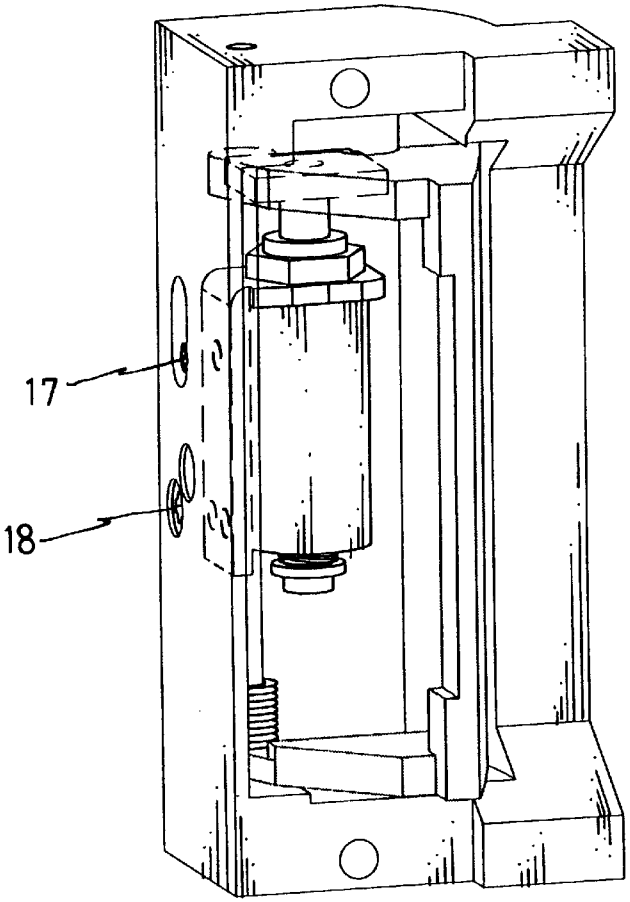

Referring next to FIGS. 6 and 7, when the fastener 18 is disengaged from the screw hole 312 of the bracket 31 and when the knob 17 is moved to the other end of the oblong hole 11 of the housing 1, the other screw hole 313 of the bracket 31 may be moved to align with the screw hole 13 of the housing 1 for threading with the fastener 18. At this moment, the block 34 is disengaged from the arm 21 of the lever 2 (FIG. 6) such that the lever 2 may be moved inward of the housing 1 against the spring 24 and such that the lever 2 is located in the released position. When the solenoid device 3 is energized to move the plunger 32 and to move the block 34 of the solenoid device 3 the position located below the arm 21 of the lever 2 or to engage with the arm 21 of the lever 2 (FIG. 7), the lever 2 may not be depressed inward of the housing 1 against the spring 24 at this moment, such that the lever 2 and thus the electrical lock device may be locked in the locked position. It is also preferable that the screw hole 312 of the bracket 31 is disengaged from the screw hole 12 of the housing 1 and shielded in the housing 1 when the fastener 18 is threaded to the screw hole 313 of the bracket 31.

Figure 8:
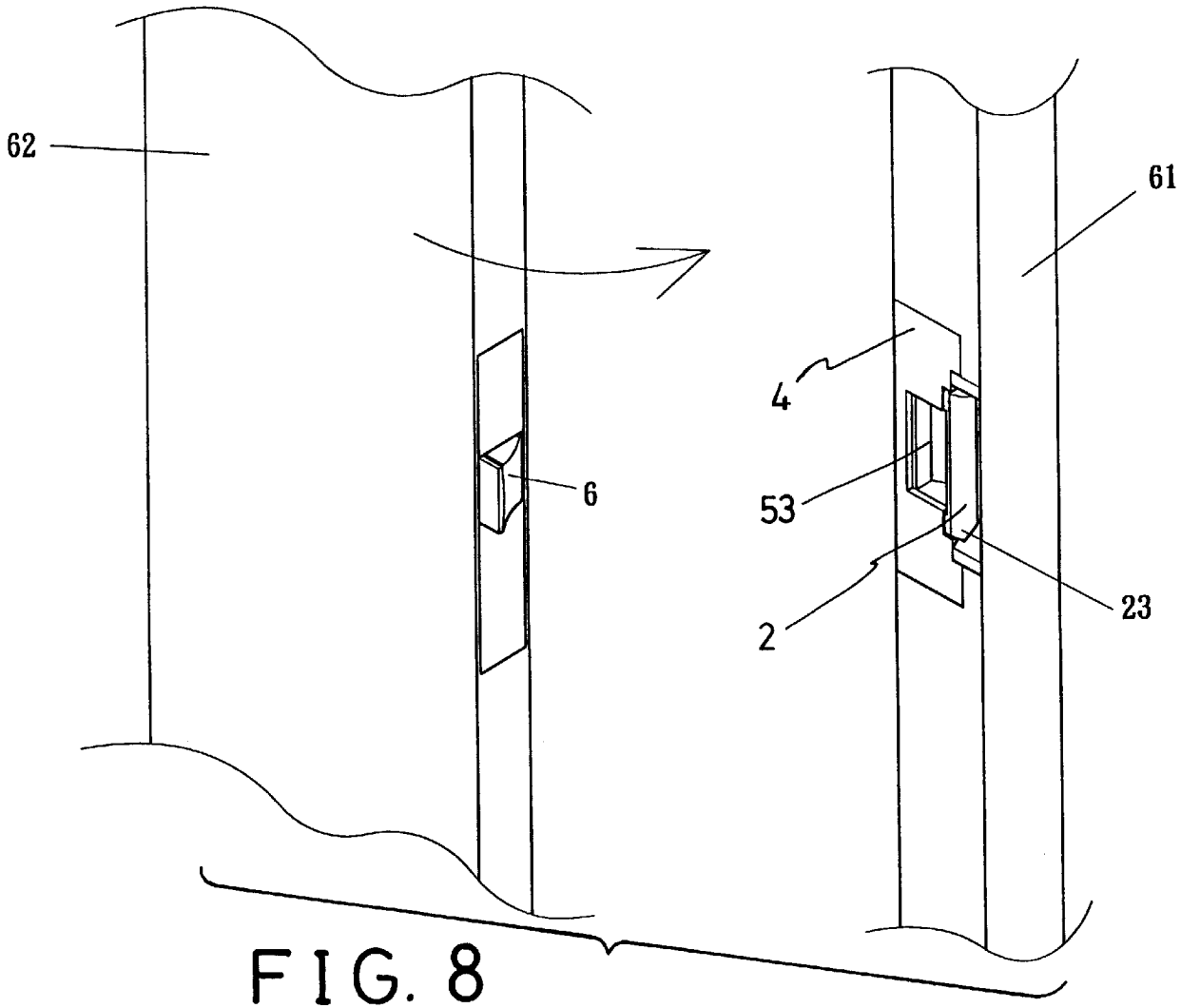
FIG. 8 is a perspective schematic view illustrating the operation of the electrical lock device, in which the door is opened relative to the other door panel or relative to the door frame.

Referring next to FIG. 8, the electrical lock device is to be engaged in and secured to a door panel or a door frame 61. The space 53 of the casing 5 is provided for receiving the latch bolt 6 that is to be engaged in and secured to a door frame or a door panel 62. The latch bolt 6 may engage with the inclined inner surface 22 or the curved outer surface 23 thereof for depressing the lever 2 inward of the housing 1 and for allowing the latch bolt 6 to be engaged into or disengaged from the space 53 of the casing 5.

Figure 5:
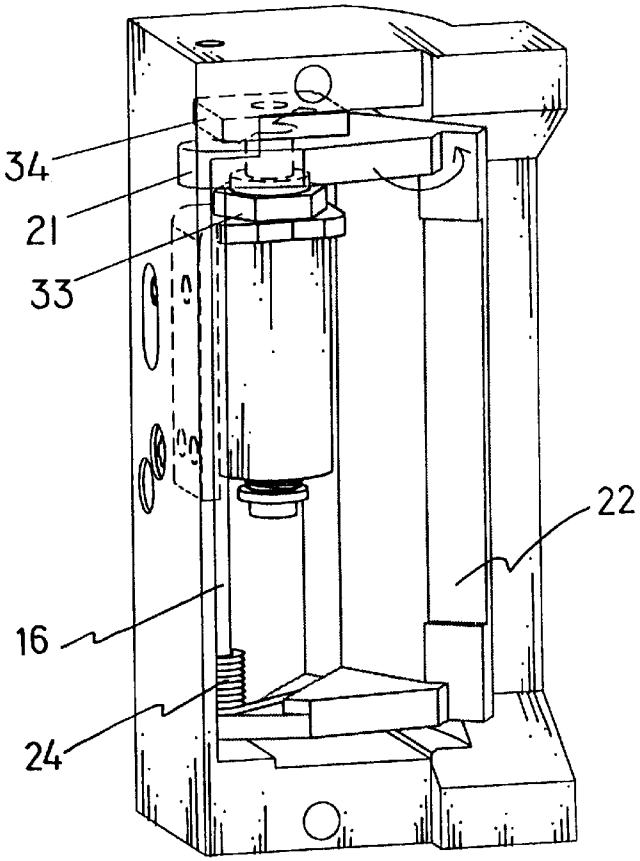
FIGS. 4 and 5 are perspective schematic views illustrating the operation of the electrical lock device.
Figure 4:
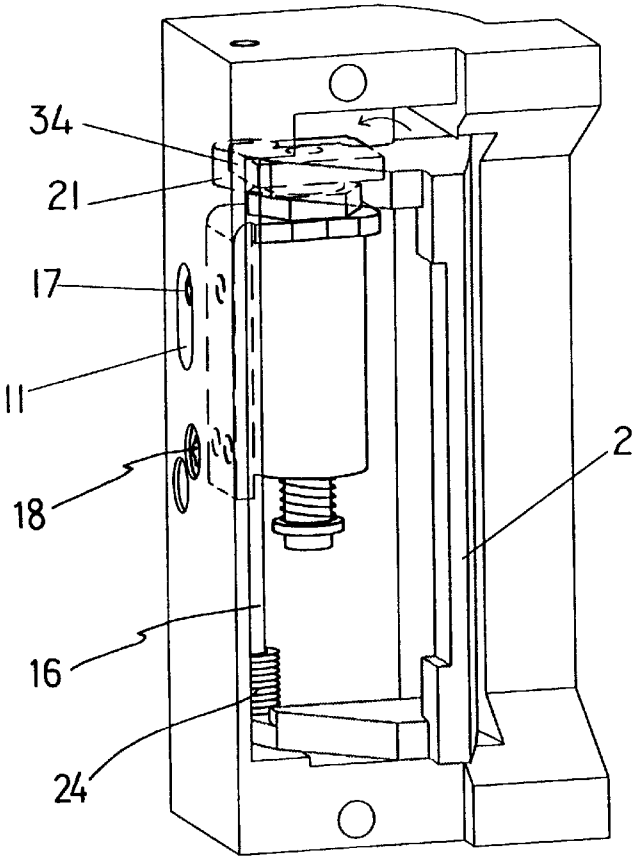

In operation, as shown in FIGS. 4 and 5, when the solenoid device 3 is not energized and when the fastener 18 is threaded with the screw hole 12 of the housing 1 to engage the block 34 with the arm 21 of the lever 2 (FIG. 4), the electrical lock device is locked or in a fail and secure position. When the solenoid device 3 is energized, the block 34 may be moved and disengaged from the arm 21 of the lever 2 (FIG. 5) such that the electrical lock device may be released to the open position.

On the contrary, as shown in FIGS. 6 and 7, when the solenoid device 3 is not energized and when the fastener 18 is threaded with the other screw hole 13 of the housing 1, the block 34 is disengaged from the arm 21 of the lever 2 (FIG. 6), the electrical lock device is released to the open position. When the solenoid device 3 is energized, the block 34 may be moved to engage with the arm 21 of the lever 2 (FIG. 7) such that the electrical lock device may be locked or in a fail and secure position.

It is to be noted that, with the provision of the screw holes 12, 13 in the housing 1 and the provision of the screw holes 312, 313 in the bracket 31 of the solenoid valve 3, the electrical lock device may be adjusted to lock the door either when the solenoid device 3 is not energized (FIG. 4) or when the solenoid device 3 is energized (FIG. 7). The electric lock device may thus be adjusted to fit the functions and the operations of both kinds of the electric lock devices as disclosed in FIGS. 4, 5 and 6, 7.

Accordingly, the electrical lock device in accordance with the present invention may be selectively adjusted to lock the door either when the solenoid device is energized or is not energized.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electrical lock device comprising:

a housing including a chamber formed therein, and including a first hole and a second hole formed therein, a lever pivotally secured to said housing at a pivot shaft, a solenoid device received in said chamber of said housing, and means for adjustably securing said solenoid device to said housing between a first position where said solenoid device is disengaged from said lever when said solenoid device is energized and a second position where said solenoid device is engaged with said lever when said solenoid device is energized, said adjusting and securing means including a fastener engaged through said first hole of said housing and secured to said solenoid device for securing said solenoid device to said housing at said first position, and engaged through said second hole of said housing and secured to said solenoid device for securing said solenoid device to said housing at said second position, said first hole and said second hole of said housing being arranged in a stagger way relative to each other.

2. The electrical lock device according to claim 1, wherein said solenoid device includes a bracket secured thereto, said bracket includes a first screw hole and a second screw hole formed therein for selectively threading with said fastener.

3. The electrical lock device according to claim 1 further comprising means for guiding said solenoid device to move in said housing.

4. An electrical lock device comprising:

a housing including a chamber formed therein, a lever pivotally secured to said housing at a pivot shaft, a solenoid device received in said chamber of said housing, and means for adjustably securing said solenoid device to said housing between a first position where said solenoid device is disengaged from said lever when said solenoid device is energized and a second position where said solenoid device is engaged with said lever when said solenoid device is energized, means for guiding said solenoid device to move in said housing, said guiding means including an oblong hole formed in said housing, and a knob slidably received in said oblong hole of said housing and secured to said solenoid device for guiding said solenoid device to move in said housing when said knob is slided along said oblong hole of said housing.

5. The electrical lock device according to claim 1, wherein said solenoid device includes a plunger slidably received therein, and a block secured to said plunger, said block is caused to engage with said lever and to prevent said lever from being depressed inward of said housing.

* * * * *